US008583438B2

(12) United States Patent
Zhao et al.

(10) Patent No.: US 8,583,438 B2
(45) Date of Patent: Nov. 12, 2013

(54) UNNATURAL PROSODY DETECTION IN SPEECH SYNTHESIS

(75) Inventors: Yong Zhao, Atlanta, GA (US); Frank Kao-ping Soong, Warren, NJ (US); Min Chu, Beijing (CN); Lijuan Wang, Beijing (CN)

(73) Assignee: Microsoft Corporation, Redmond, WA (US)

( * ) Notice: Subject to any disclaimer, the term of this patent is extended or adjusted under 35 U.S.C. 154(b) by 1151 days.

(21) Appl. No.: 11/903,020

(22) Filed: Sep. 20, 2007

(65) Prior Publication Data

US 2009/0083036 A1 Mar. 26, 2009

(51) Int. Cl.
*G10L 13/00* (2006.01)

(52) U.S. Cl.
USPC ..... 704/260; 704/258

(58) Field of Classification Search
USPC ..... 704/258, 260
See application file for complete search history.

(56) References Cited

U.S. PATENT DOCUMENTS

| | | | | |
|---|---|---|---|---|
| 5,940,797 | A | 8/1999 | Abe | |
| 6,029,132 | A * | 2/2000 | Kuhn et al. | 704/260 |
| 6,778,962 | B1 | 8/2004 | Kasai et al. | |
| 6,845,358 | B2 * | 1/2005 | Kibre et al. | 704/260 |
| 6,961,704 | B1 | 11/2005 | Phillips et al. | |
| 6,996,529 | B1 | 2/2006 | Minnis | |
| 7,299,188 | B2 * | 11/2007 | Gupta et al. | 704/276 |
| 7,401,020 | B2 * | 7/2008 | Eide | 704/258 |
| 2002/0128841 | A1 * | 9/2002 | Kibre et al. | 704/260 |
| 2003/0028376 | A1 * | 2/2003 | Meron | 704/258 |
| 2003/0198368 | A1 * | 10/2003 | Kee | 382/118 |
| 2003/0229494 | A1 * | 12/2003 | Rutten et al. | 704/254 |
| 2004/0006461 | A1 * | 1/2004 | Gupta et al. | 704/200 |
| 2005/0060155 | A1 * | 3/2005 | Chu et al. | 704/269 |
| 2005/0119890 | A1 | 6/2005 | Hirose | |
| 2005/0119891 | A1 | 6/2005 | Chu et al. | |
| 2005/0159954 | A1 * | 7/2005 | Chu et al. | 704/254 |
| 2005/0182629 | A1 * | 8/2005 | Coorman et al. | 704/266 |
| 2005/0267758 | A1 * | 12/2005 | Shi et al. | 704/260 |
| 2006/0074674 | A1 * | 4/2006 | Zhang et al. | 704/260 |
| 2006/0074678 | A1 * | 4/2006 | Pearson et al. | 704/267 |
| 2006/0136213 | A1 * | 6/2006 | Hirose et al. | 704/260 |
| 2006/0259303 | A1 * | 11/2006 | Bakis | 704/268 |
| 2006/0287861 | A1 * | 12/2006 | Fischer et al. | 704/260 |

(Continued)

OTHER PUBLICATIONS

Huang, et al., "Whistler: A Trainable Text-To-Speech System", pp. 1-4.

(Continued)

*Primary Examiner* — Douglas Godbold
(74) *Attorney, Agent, or Firm* — L. Alan Collins; Collins & Collins Intellectual, LLC

(57) ABSTRACT

Described is a technology by which synthesized speech generated from text is evaluated against a prosody model (trained offline) to determine whether the speech will sound unnatural. If so, the speech is regenerated with modified data. The evaluation and regeneration may be iterative until deemed natural sounding. For example, text is built into a lattice that is then (e.g., Viterbi) searched to find a best path. The sections (e.g., units) of data on the path are evaluated via a prosody model. If the evaluation deems a section to correspond to unnatural prosody, that section is replaced, e.g., by modifying/pruning the lattice and re-performing the search. Replacement may be iterative until all sections pass the evaluation. Unnatural prosody detection may be biased such that during evaluation, unnatural prosody is falsely detected at a higher rate relative to a rate at which unnatural prosody is missed.

15 Claims, 5 Drawing Sheets

(56) References Cited

U.S. PATENT DOCUMENTS

| | | | | |
|---|---|---|---|---|
| 2007/0100628 | A1* | 5/2007 | Bodin et al. | 704/261 |
| 2008/0027727 | A1* | 1/2008 | Morita et al. | 704/267 |
| 2008/0183473 | A1* | 7/2008 | Nagano et al. | 704/258 |
| 2008/0270139 | A1* | 10/2008 | Shi et al. | 704/260 |
| 2009/0070115 | A1* | 3/2009 | Tachibana et al. | 704/260 |
| 2010/0004931 | A1* | 1/2010 | Ma et al. | 704/244 |

OTHER PUBLICATIONS

Huan, et al., "Recent Improvements on Michael's Trainable Sample Paper System—Whistle", pp. 1-4.

Li, et al., "Analysis and Modeling of F0 Contours for Cantonese Text-to-Speech", Date: Sep. 2004, vol. 3, Issue: 3, ACM Press, New York, USA.

Katae, et al., "Natural Prosody Generation for Domain Specific Text-to-Speech Systems", pp. 1-4.

Sproat, et al., "The Need for Increased Speech Synthesis Research: Report of the 1998 NSF Workshop for Discussing Research Priorities and Evaluation Strategies in Speech Synthesis", Date: Mar. 5, 1999, pp. 1-72.

Tesprasit, et al., "Learning Phrase Break Detection in Thai Text-to-Speech", Date: 2003, pp. 1-4, Eurospeech, Geneva.

Hunt, "Unit Selection in a Concatenative Speech Synthesis System Using a Large Speech Database", Proceedings of the 1996 IEEE International Conference on Acoustics, Speech, and Signal Processing, ICASSP, May 7-10, 1996.

Donovan, "The IBM Trainable Speech Synthesis System", Proceedings of the 5th International Conference on Spoken Language Processing, ICSLP, Nov. 30-Dec. 4, 1998.

Chu, "Microsoft Mulan—A Bilingual TTS System," Proceedings of the 2003 IEEE International Conference on Acoustics, Speech, and Signal Processing, ICASSP, Apr. 6-10, 2003.

Rutten, "The application of interactive speech unit selection in TTS systems", Proceedings of the 8th European Conference on Speech Communication and Technology, EUROSPEECH, Sep. 1-4, 2003.

* cited by examiner

UNNATURAL PROSODY DETECTION IN SPEECH SYNTHESIS

BACKGROUND

In recent years, the field of text-to-speech (TTS) conversion has been largely researched, with text-to-speech technology appearing in a number of commercial applications. Recent progress in unit-selection speech synthesis and Hidden Markov Model (HMM) speech synthesis has led to considerably more natural-sounding synthetic speech, which thus makes such speech suitable for many types of applications.

Some contemporary text-to-speech systems adopt corpus-driven approaches, in which corpus refers to a representative body of utterances such as words or sentences, due to such systems' abilities in generating relatively natural speech. In general, these systems access a large database of segmental samples, from which the best unit sequence with a minimum distortion cost is retrieved for generating speech output.

However, although such a sample-based approach generally synthesizes speech with high-level intelligibility and naturalness, instability problems due to critical errors and/or glitches occasionally occur and ruin the perception of the whole utterance. This is one factor that prevents text-to-speech from being widely accepted in applications such as in commercial services.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Briefly, various aspects of the subject matter described herein are directed towards a technology by which speech generated from text is evaluated against a prosody model to determine whether unnatural prosody exists. If so, the speech is re-generated from modified data to obtain more natural sounding speech. The evaluation and re-generation may be iterative until a naturalness threshold is reached.

In one example implementation, the text is built into a lattice that is then searched, such as via a cost-based (e.g., Viterbi) search to find a best path through the lattice. One or more sections (e.g., units) of data on the path are evaluated via a prosody model that detects unnatural prosody. If the evaluation deems a section to correspond to unnatural prosody, that section is replaced with another section. In one example, replacement occurs by modifying (e.g., pruning) the lattice and re-performing a search using the modified lattice. Such replacement may be iterative until all sections pass the evaluation (or some iteration limit is reached).

The prosody model may be trained using an actual speech data store. Further, unnatural prosody detection may be biased such that during evaluation, unnatural prosody is falsely detected at a higher rate relative to a rate at which unnatural prosody is missed. In general, this is because a miss is more likely to result in an unnatural sounding utterance, whereas a false detection (false alarm) is likely to be replaced with an acceptable alternate section given a sufficiently large data store.

In one example, the search mechanism comprises a Viterbi search algorithm that determines a lowest cost path through a lattice built from text. The unnatural prosody model may be incorporated into the search algorithm, or can be loosely coupled thereto by post-search evaluation and iteration including lattice modification to correct speech deemed unnatural sounding.

Other advantages may become apparent from the following detailed description when taken in conjunction with the drawings.

BRIEF DESCRIPTION OF THE DRAWINGS

The present invention is illustrated by way of example and not limited in the accompanying figures in which like reference numerals indicate similar elements and in which.

DETAILED DESCRIPTION

Various aspects of the technology described herein are generally directed towards an unnatural prosody detection model that identifies unnatural prosody in speech synthesized from text, (wherein prosody generally refers to an utterance's stress and intonation patterns). For example, unnatural prosody includes badly-uttered segments, unsmoothed concatenation and/or wrong accents and intonations. The unnatural sounding speech is then replaced by more natural-sounding speech.

Figure 1:
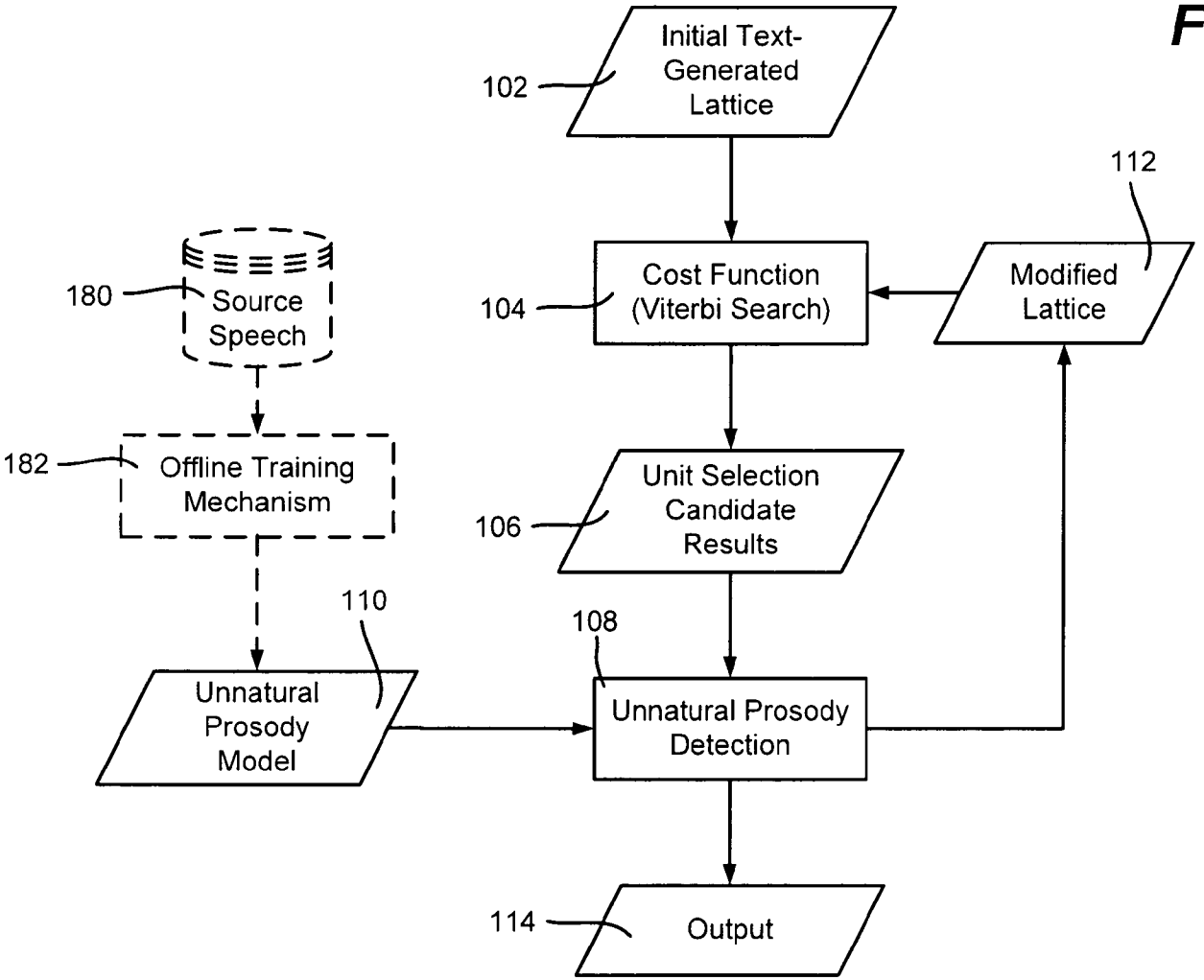
FIG. 1 is a block diagram representative of general conceptual aspects of detecting unnatural prosody in synthesized speech.

Some of these various aspects are conceptually represented in the example of FIG. 1, in which a unit selection model with unnatural prosody detection is incorporated into a text-to-speech service or the like. In text-to-speech systems in general, given a set of text, a unit database is accessed, from which a lattice 102 (e.g., of units) is built based on that text. A cost function such as in the form of a Viterbi search mechanism 104 processes the lattice and finds each speech unit corresponding to the text, that is, by searching for an optimal path through the lattice.

Unlike conventional text-to-speech systems, however, rather than directly accepting the speech unit corresponding to the lowest-cost path, the iterative unit selection model treats the search results as a candidate unit selection 106. More particularly, the iterative unit selection model includes an unnatural prosody detection mechanism 108 that verifies the searched candidates' naturalness by a prosody detection model 110, and if any section (e.g., of one or more units) is deemed unnatural, replaces that section with a better candidate until a natural sounding candidate (or the best candidate) is found.

For example, in FIG. 1, if unnaturalness is detected as described below, the lattice is modified, e.g., the unnatural path section or sections pruned out or otherwise disabled into a modified lattice 112, and the modified lattice iteratively searched via the Viterbi search mechanism 104. The iteration continues until the unit selection passes a naturalness verification test, (or up to some limit of iterations in which event the most natural candidate is selected), with the resulting unit selection then provided as output 114. Note that in contrast to conventional prosody prediction, an unnatural prosody detection model as described herein facilitates prosody variations, e.g., the model 110 may be changed to suit any desired variation. Further, as will be understood, the implementation of the prosody model is unlike conventional prosody prediction models, which aim to predict deterministic prosodic values given the input of text transcriptions. With conventional prosody prediction models, repetitious and monotonous prosody patterns are perceived because natural variations in prosody of human speech are replaced with the most frequently used patterns. In contrast, unnatural prosody detection as described herein constrains and adjusts the prosody of synthetic speech in a natural-sounding way, rather than forcing it through a pre-designed trajectory.

Note that while various examples herein are primarily directed to iterative unit selection aspects, it is understood that these iterative aspects and other aspects are only examples. For example, an alternative framework with an unnatural prosody module may be embedded into a more complex Viterbi search mechanism, such that the module turns off those unnatural paths during the online search, without the need for independent synthesis iterations; (e.g., using the components labeled of FIG. 1, the Viterbi search mechanism can incorporate the component 108, although this requires a relatively tighter coupling between the search mechanism and the detection model). As such, the present invention is not limited to any particular embodiments, aspects, concepts, structures, functionalities or examples described herein. Rather, any of the embodiments, aspects, concepts, structures, functionalities or examples described herein are non-limiting, and the present invention may be used various ways that provide benefits and advantages in computing and speech technology in general.

Figure 2:
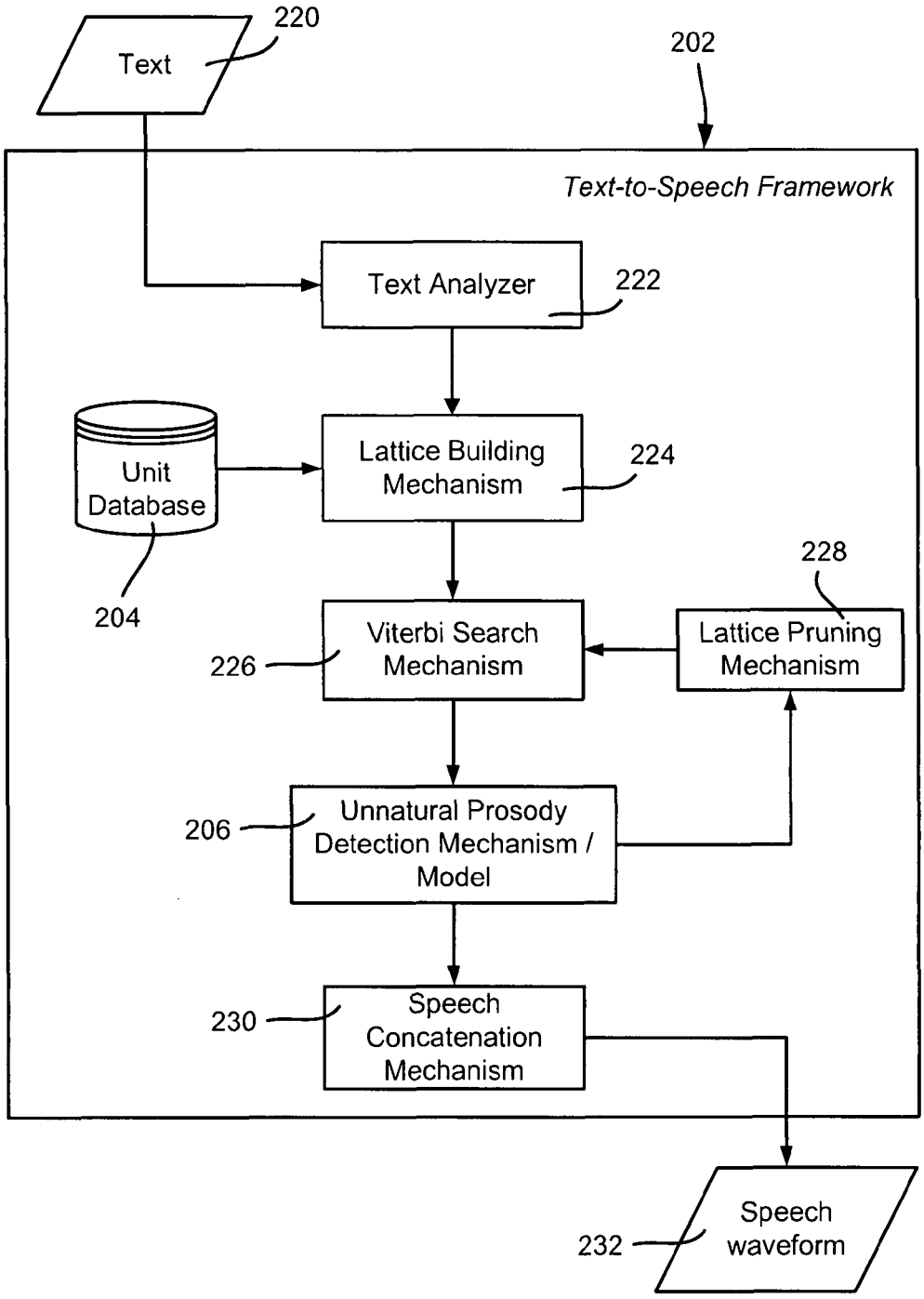
FIG. 2 is a block diagram representative of an example architecture of a text-to-speech framework that includes unnatural prosody detection via an iterative mechanism.

Turning to FIG. 2, there is shown an example text-to-speech framework 202 including an iterative unit selection system integrated with an unnatural prosody detection model to identify any unnatural prosody. Note that components of the framework 202 may comprise a text-to-speech service/engine, into which a unit database 204 and/or an unnatural prosody detection mechanism/model 206 may be plugged in or otherwise accessed. As described below, such a framework 202 benefits from and effectively uses plentiful candidate units within the unit database 204.

In general, given a set of text 220, the service 202 analyzes the text via a mechanism 222 to build a lattice from the unit database 204 via a mechanism 224. A cost function such as in the form of a Viterbi search mechanism (algorithm) 226 searches the unit lattice to find an optimal unit path. Instead of directly accepting such a path, the unnatural prosody detection mechanism/model 206 verifies the path's naturalness, e.g., each section such as in the form of a unit, and replaces any unnatural section with a better candidate. Detection and iteration continues until each section passes the verification test (or some iteration limit is reached). For example, in FIG. 2 the lattice is pruned by a lattice pruning mechanism 228 to remove an unnatural unit or set of units corresponding to a section, and the Viterbi search 226 re-run on the pruned lattice.

When the resultant path is deemed natural (up to any iteration limits), a speech concatenation mechanism 228 assembles the units into a synthesized speech waveform 230. The iterative speech synthesis framework thus automates naturalness detection by post-processing the optimized unit path with a confidence measure module, pruning out those incongruous units and search, until the whole unit path passes.

Note that the iterative approach described herein allows an existing cost function to be used, via a loose coupling with the unnatural prosody detection model. Further, as will be understood below, this provides the capability to take into account various prosodic features, such as at a syllable and/or word level.

Figure 3:
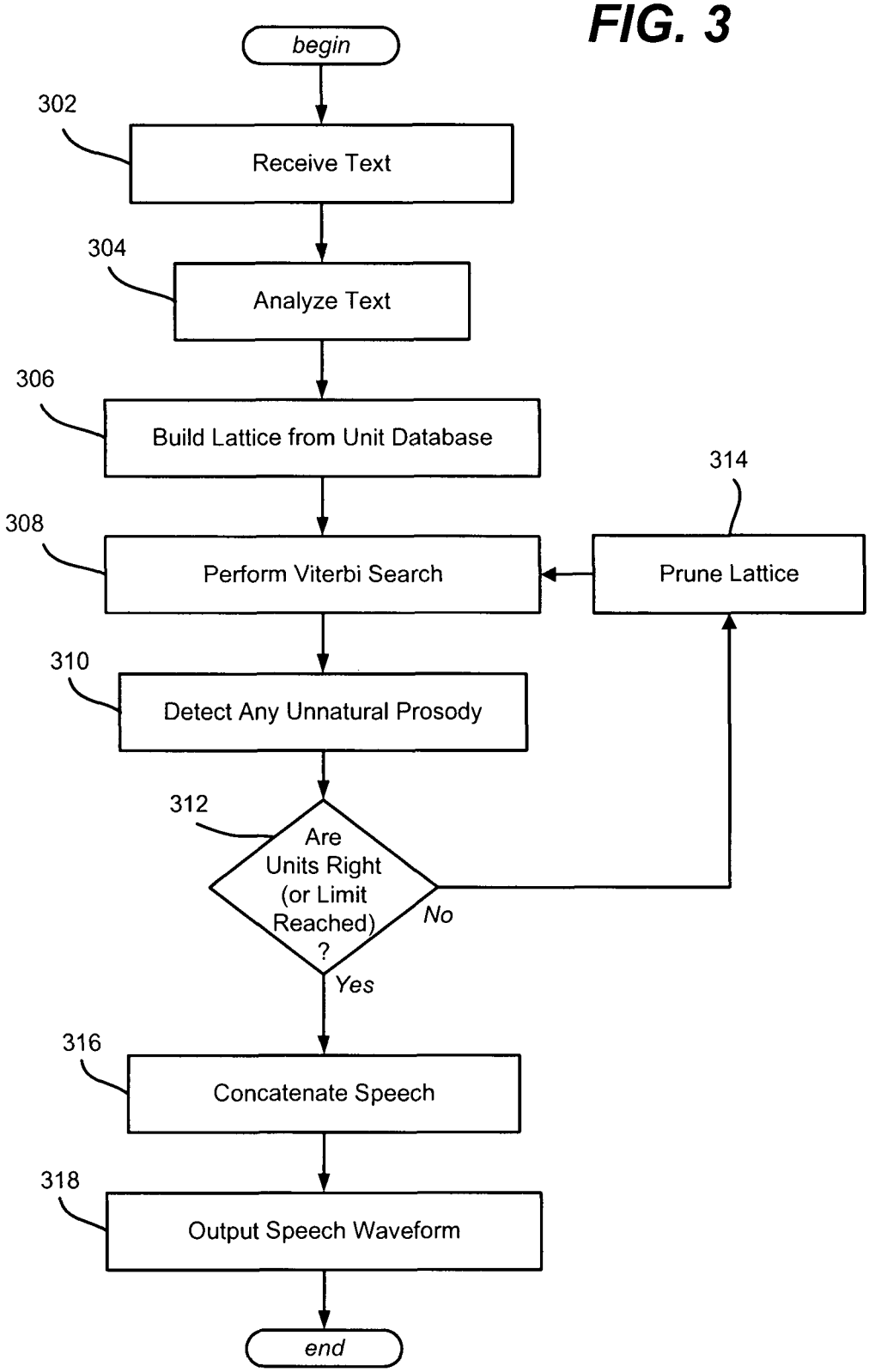
FIG. 3 is a flow diagram representative of example steps that may be taken to detect unnatural prosody including via iteration.

As similarly represented in the flow diagram of FIG. 3, iterative unit selection synthesis comprises an iterative procedure with rounds of two-pass scoring. In a first stage, when speech is received and analyzed with a lattice built for the transcription from the unit database (steps 302, 304 and 306), a Viterbi search is performed (step 308) to find a best unit path conforming to the guidance of the transcription.

In a second stage, the sequence of units is scored (step 310) by one or more detection (verification) models to compute likelihood ratios. An unnatural prosody detection model is aimed to detect any occurrence in the synthesized speech that sounds unnatural in prosody. For example, given a feature X observed from synthesized speech, a choice is made between two hypotheses:

$H_0$: X is natural in prosody $H_1$: X is unnatural in prosody

A decision is based on a likelihood ratio test:

$$LR(X) = \frac{P(X \mid H_0)}{P(X \mid H_1)} \begin{cases} \geq \theta & \text{choose } H_0 \\ < \theta & \text{choose } H_1 \end{cases}$$

where $P(X|H_i)$ is the likelihood of the hypothesis $H_i$ with respect to the observed feature X.

Thus, if at step 312 there are one or more unnatural units that do not pass the test, they are pruned out at step 314 from the lattice, and the next iteration continues (by returning to step 308). The iterations continue until a unit sequence entirely passes the verification, or a preset value of maximum iterations is reached.

In the unnatural prosody detection, two types of errors are possible, namely removing a natural sounding unit, referred to herein as a false alarm, or not detecting unnatural sounding speech, referred to herein as a miss. If $\lambda_{ij}$ (e.g., in the form of a token) is the loss of deciding $D_i$ when the true class is $H_j$, then the expected risks for two types of errors, false alarm (fa) and a miss (ms), are:

$$R_{fa}=\lambda_{10}P(D_i|H_0)P(H_0)$$

$$R_{ms}=\lambda_{01}P(D_0|H_1)P(H_1)$$

Figure 4:
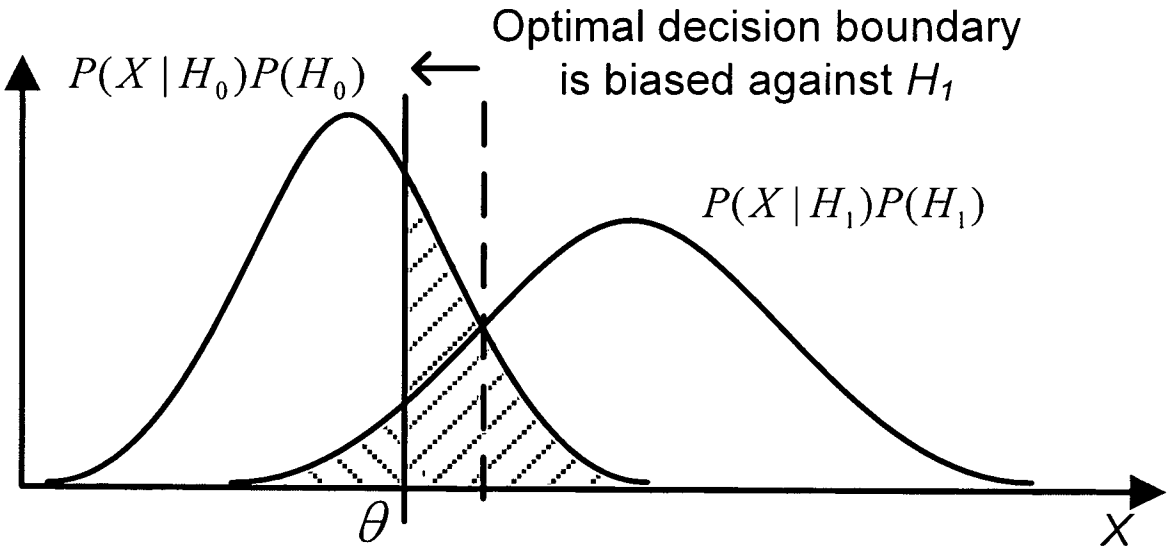
FIG. 4 is a visual representation of an example graph that demonstrates biasing an unnatural prosody detection model to favor a false detection of unnatural speech (false alarm) over missing unnatural speech within a set of synthesized speech.

However, unnatural section or sections tend to destroy the perception of the whole utterance, whereby the miss cost, $\lambda_{01}$, is significant. Conversely, iterative unit selection removes detected unnatural sections, and re-synthesizes the utterance. Provided that the unit database is large and thereby candidate units are available in a sufficient amount, the false alarm cost of mistakenly removing a natural-sounding token $\lambda_{10}$ is not significant, as it is as small as a lattice search run. As a result, unnatural prosody detection is a two-class classification problem with unequal misclassification costs, in which the loss resulting from a false alarm is significantly less than the loss resulting from a miss. To minimize the total risk, e.g., the sum of $R_{fa}$ and $R_{ms}$, the optimal decision boundary is intentionally biased against $H_1$, as illustrated in FIG. 4. As a result, one example unnatural prosody model works at a somewhat high false detection rate, an undemanding requirement for the implementation of confidence measure.

Returning to FIG. 3, the iteration ends when step 312 determines that all sections (e.g., units) are verified as natural, or some iteration limit number (e.g., five times) is reached. Steps 316 and 318 represent concatenation of the speech and outputting of the synthesized speech waveform, respectively.

As mentioned above, it is feasible to incorporate (or otherwise tightly couple) an unnatural prosody module into the search mechanism, e.g., by turning off paths in the lattice during the online search. This generally defines a non-linear cost function, where the cost is close to zero when the feature distance is below a threshold, and becomes infinity when above that threshold. However, this alternative framework may lose some advantages that exist in the iterative approach, such as advantages that allow a high false alarm rate, and the advantage of a generally loose coupling with the cost function, e.g., whereby different unnatural prosody models may be used as desired.

With respect to training an unnatural prosody model, as described above, an unnatural prosody model is designed to detect any unnatural prosody in synthetic speech. To this end, one approach is to learn naturalness patterns from real speech. For example, a synthetic utterance that sounds natural in perception exhibits prosodic characteristics similar to those of real speech:

$$P(X|H_0) \approx P(X|N)$$

where P(X|N) is the probability density of a feature X given real speech N. Thus, natural prosody is learned from a source speech corpus; for completeness, FIG. 1 shows the unnatural prosody model 110 being trained using such source speech 180 and an offline training mechanism 182; (the dashed lines and boxes are used to indicate that the training aspects are performed separately from the online detection aspects).

To characterize prosody patterns of real speech, one example implementation employs decision trees, in which a splitting criterion maximizes the reduction of Mean Square Error (MSE). Phonetic and prosodic contextual factors, such as phonemes, break indices, stress and emphasis, are taken into account to split trees.

In one example, the likelihood of naturalness is measured using synthetic tokens. In this example, a decision threshold is chosen in terms of P(X|N), independent of the distribution of alternative hypothesis $H_1$. In this way, it works at a constant false alarm rate.

During unnaturalness detection, given the observation X of a token, a leaf node is found by traversing the tree with context features of that token. The distance between X and the kernel of the leaf node is used to reflect the likelihood of naturalness:

$$z(X) = \sqrt{\sum_{j=1}^{N} \frac{(x_j - \mu_j)^2}{\sigma_j^2}}$$

where $\mu_j$ and $\sigma_j$ denotes the mean and standard deviation of the $j^{th}$-dimension of the leaf node. When z(X) is larger than a preset value, unnaturalness is decided to be present.

In one example, four token types are used in confidence measures, including phoneme (Phn), phoneme boundary (PhnBnd), syllable (Syl) and syllable boundary (SylBnd). Models Phn and Syl aim to measure the fitness of prosody, while models PhnBnd and SylBnd reflect the transition smoothness of spliced units. The contextual factors and observation features for each decision tree are set forth in the tables below.

As described above, the system removes from the lattice any units having a score above a threshold. As for Models Phn and Syl, confidence scores estimated by models are duplicated to the phonemes enclosed by the focused tokens. For the models PhnBnd and SylBnd, confidence scores are divided into halves and assigned to left/right tokens.

The table below represents example contextual factors involved in decision trees to learn unnatural prosody patterns, in which X indicates the item being checked and L/R denotes including left/right tokens:

| Contextual factors | Phn | PhnBnd | Syl | SylBnd |
|---|---|---|---|---|
| Position of word in phrase | X | L/R | X | L/R |
| Position of syllable in word | X | L/R | X | L/R |
| Position of phone in syllable | X | L/R | — | — |
| Stress, emphasis | X | L/R | X | L/R |
| Current phoneme | X | L/R | — | — |
| Left/right phoneme | X | — | — | — |
| Break index of boundary | — | X | — | X |

The table below represents example acoustic features used in an unnatural prosody model, in which X indicates the item being checked; as for boundary models, D denotes the difference between left/right tokens, and L/R denotes including both left/right tokens:

| Acoustic features | Phn | PhnBnd | Syl | SylBnd |
|---|---|---|---|---|
| Duration | X | D | X | D |
| $F_0$ mean, std. dev. and range | X | D | X | D |
| $F_0$ at head, middle and tail | X | D | X | D |
| $F_0$ difference at boundary | — | X | — | X |

Exemplary Operating Environment

Figure 5:
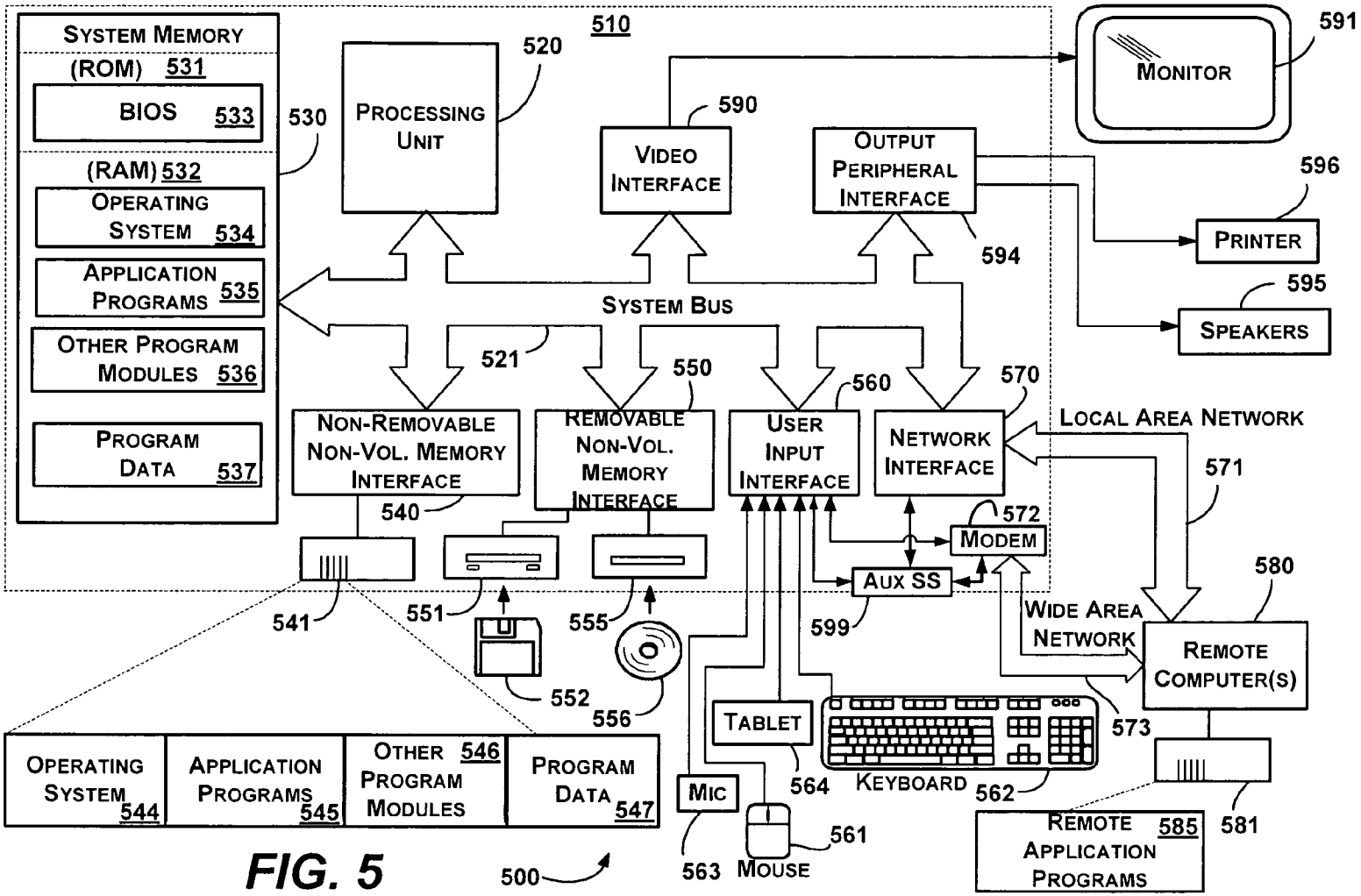
FIG. 5 shows an illustrative example of a general-purpose network computing environment into which various aspects of the present invention may be incorporated.

FIG. 5 illustrates an example of a suitable computing system environment 500 on which the examples of FIGS. 1-3 may be implemented. The computing system environment 500 is only one example of a suitable computing environment and is not intended to suggest any limitation as to the scope of use or functionality of the invention. Neither should the computing environment 500 be interpreted as having any dependency or requirement relating to any one or combination of components illustrated in the exemplary operating environment 500.

The invention is operational with numerous other general purpose or special purpose computing system environments or configurations. Examples of well known computing systems, environments, and/or configurations that may be suitable for use with the invention include, but are not limited to: personal computers, server computers, hand-held or laptop devices, tablet devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, and so forth, which perform particular tasks or implement particular abstract data types. The invention may also be practiced in distributed computing environments where tasks are performed by remote processing devices that are linked through a communications network. In a distributed computing environment, program modules may be located in local and/or remote computer storage media including memory storage devices.

With reference to FIG. 5, an exemplary system for implementing various aspects of the invention may include a general purpose computing device in the form of a computer 510. Components of the computer 510 may include, but are not limited to, a processing unit 520, a system memory 530, and a system bus 521 that couples various system components including the system memory to the processing unit 520. The system bus 521 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer 510 typically includes a variety of computer-readable media. Computer-readable media can be any available media that can be accessed by the computer 510 and includes both volatile and nonvolatile media, and removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by the computer 510. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

The system memory 530 includes computer storage media in the form of volatile and/or nonvolatile memory such as read only memory (ROM) 531 and random access memory (RAM) 532. A basic input/output system 533 (BIOS), containing the basic routines that help to transfer information between elements within computer 510, such as during start-up, is typically stored in ROM 531. RAM 532 typically contains data and/or program modules that are immediately accessible to and/or presently being operated on by processing unit 520. By way of example, and not limitation, FIG. 5 illustrates operating system 534, application programs 535, other program modules 536 and program data 537.

The computer 510 may also include other removable/non-removable, volatile/nonvolatile computer storage media. By way of example only, FIG. 5 illustrates a hard disk drive 541 that reads from or writes to non-removable, nonvolatile magnetic media, a magnetic disk drive 551 that reads from or writes to a removable, nonvolatile magnetic disk 552, and an optical disk drive 555 that reads from or writes to a removable, nonvolatile optical disk 556 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 541 is typically connected to the system bus 521 through a non-removable memory interface such as interface 540, and magnetic disk drive 551 and optical disk drive 555 are typically connected to the system bus 521 by a removable memory interface, such as interface 550.

The drives and their associated computer storage media, described above and illustrated in FIG. 5, provide storage of computer-readable instructions, data structures, program modules and other data for the computer 510. In FIG. 5, for example, hard disk drive 541 is illustrated as storing operating system 544, application programs 545, other program modules 546 and program data 547. Note that these components can either be the same as or different from operating system 534, application programs 535, other program modules 536, and program data 537. Operating system 544, application programs 545, other program modules 546, and program data 547 are given different numbers herein to illustrate that, at a minimum, they are different copies. A user may enter commands and information into the computer 510 through input devices such as a tablet, or electronic digitizer, 564, a microphone 563, a keyboard 562 and pointing device 561, commonly referred to as mouse, trackball or touch pad. Other input devices not shown in FIG. 5 may include a joystick, game pad, satellite dish, scanner, or the like. These and other input devices are often connected to the processing unit 520 through a user input interface 560 that is coupled to the system bus, but may be connected by other interface and bus structures, such as a parallel port, game port or a universal serial bus (USB). A monitor 591 or other type of display device is also connected to the system bus 521 via an interface, such as a video interface 590. The monitor 591 may also be integrated with a touch-screen panel or the like. Note that the monitor and/or touch screen panel can be physically coupled to a housing in which the computing device 510 is incorporated, such as in a tablet-type personal computer. In addition, computers such as the computing device 510 may also include other peripheral output devices such as speakers 595 and printer 596, which may be connected through an output peripheral interface 594 or the like.

The computer 510 may operate in a networked environment using logical connections to one or more remote computers, such as a remote computer 580. The remote computer 580 may be a personal computer, a server, a router, a network PC, a peer device or other common network node, and typically includes many or all of the elements described above relative to the computer 510, although only a memory storage device 581 has been illustrated in FIG. 5. The logical connections depicted in FIG. 5 include one or more local area networks (LAN) 571 and one or more wide area networks (WAN) 573, but may also include other networks. Such networking environments are commonplace in offices, enterprise-wide computer networks, intranets and the Internet.

When used in a LAN networking environment, the computer 510 is connected to the LAN 571 through a network interface or adapter 570. When used in a WAN networking environment, the computer 510 typically includes a modem 572 or other means for establishing communications over the WAN 573, such as the Internet. The modem 572, which may be internal or external, may be connected to the system bus 521 via the user input interface 560 or other appropriate mechanism. A wireless networking component 574 such as comprising an interface and antenna may be coupled through a suitable device such as an access point or peer computer to a WAN or LAN. In a networked environment, program modules depicted relative to the computer 510, or portions thereof, may be stored in the remote memory storage device. By way of example, and not limitation, FIG. 5 illustrates remote application programs 585 as residing on memory device 581. It may be appreciated that the network connections shown are exemplary and other means of establishing a communications link between the computers may be used.

An auxiliary subsystem 599 (e.g., for auxiliary display of content) may be connected via the user interface 560 to allow data such as program content, system status and event notifications to be provided to the user, even if the main portions of the computer system are in a low power state. The auxiliary subsystem 599 may be connected to the modem 572 and/or network interface 570 to allow communication between these systems while the main processing unit 520 is in a low power state.

Conclusion

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. At least one computer storage medium having computer-executable instructions that, when executed by a computer, cause the computer to perform a method comprising:

building, based on text, a lattice comprising speech units, wherein each speech unit in the lattice is obtained from a database comprising a plurality of candidate speech units;

finding, by the computer in the lattice, a sequence of speech units that conforms to the text;

pruning, by the computer from the sequence of speech units, any of the speech units in the sequence that, based on likelihood ratios and a prosody model that was trained using actual speech, are detected to have unnatural prosody, where the prosody model exhibits a bias toward detecting unnatural prosody;

iterating, by the computer, the finding and the pruning until completion that is based on a condition selected from a group of conditions comprising: 1) every speech unit in the sequence corresponding to natural prosody, and 2) iterating a maximum number of iterations.

2. The at least one computer storage medium of claim 1, the method further comprising concatenating, in response to the completion, the speech units of the sequence resulting in a speech waveform the corresponds to the text.

3. The at least one computer storage medium of claim 1 wherein the pruning further comprises replacing the speech unit in the lattice with one of the candidate speech units.

4. The at least one computer storage medium of claim 1 wherein the pruning further comprises searching the lattice using a Viterbi search algorithm to find the sequence.

5. The at least one computer storage medium of claim 1 wherein the pruning further comprises measuring a phoneme fitness and a syllable fitness and a transition smoothness of the speech units in the sequence.

6. A method comprising:

building, by a computer and based on text, a lattice comprising speech units, wherein each speech unit in the lattice is obtained from a database comprising a plurality of candidate speech units;

finding, by the computer in the lattice, a sequence of speech units that conforms to the text;

pruning, by the computer from the sequence of speech units, any of the speech units in the sequence that, based on likelihood ratios and a prosody model that was trained using actual speech, are detected to have unnatural prosody, where the prosody model exhibits a bias toward detecting unnatural prosody;

iterating, by the computer, the finding and the pruning until completion that is based on a condition selected from a group of conditions comprising: 1) every speech unit in the sequence corresponding to natural prosody, and 2) iterating a maximum number of iterations.

7. The method of claim 6 further comprising concatenating, in response to the completion, the speech units of the sequence resulting in a speech waveform the corresponds to the text.

8. The method of claim 6 wherein the pruning further comprises replacing the speech unit in the lattice with one of the candidate speech units.

9. The method of claim 6 wherein the pruning further comprises searching the lattice using a Viterbi search algorithm to find the sequence.

10. The method of claim 6 wherein the pruning further comprises measuring a phoneme fitness and a syllable fitness and a transition smoothness of the speech units in the sequence.

11. A system comprising:

a computer;

a text analyzer implemented at least in part by the computer and configured for building, based on text, a lattice comprising speech units, wherein each speech unit in the lattice is obtained from a database comprising a plurality of candidate speech units;

a search mechanism implemented at least in part by the computer and configured for finding, in the lattice, a sequence of speech units that conforms to the text;

a pruning mechanism implemented at least in part by the computer and configured for pruning, from the sequence of speech units, any of the speech units in the sequence that, based on likelihood ratios and a prosody model that was trained using actual speech, are detected to have unnatural prosody, where the prosody model exhibits a bias toward detecting unnatural prosody;

a detection mechanism implemented at least in part by the computer and configured for iterating the finding and the pruning until completion that is based on a condition selected from a group of conditions comprising: 1) every speech unit in the sequence corresponding to natural prosody, and 2) iterating a maximum number of iterations.

12. The system of claim 11 further comprising a concatenation mechanism implemented by the computer and configured for concatenating, in response to the completion, the speech units of the sequence resulting in a speech waveform the corresponds to the text.

13. The system of claim 11 wherein the pruning further comprises replacing the speech unit in the lattice with one of the candidate speech units.

14. The system of claim 11 wherein the pruning further comprises searching the lattice using a Viterbi search algorithm to find the sequence.

15. The system of claim 11 wherein the pruning further comprises measuring a phoneme fitness and a syllable fitness and a transition smoothness of the speech unit.

* * * * *